United States Patent [19]

Tanaka et al.

[11] 4,353,648

[45] Oct. 12, 1982

[54] COPY PAPER SEPARATING METHOD FOR USE IN ELECTROPHOTOGRAPHIC COPYING APPARATUS

[75] Inventors: Susumu Tanaka; Tateki Oka, both of Sakai; Hiroshi Mizuno, Ikoma, all of Japan

[73] Assignee: Minolta Camera Kabushiki Kaisha, Japan

[21] Appl. No.: 199,220

[22] Filed: Oct. 21, 1980

[30] Foreign Application Priority Data

Oct. 23, 1979 [JP] Japan ..... 54-136679

[51] Int. Cl.[3] ..... G03G 15/06; G03G 13/06

[52] U.S. Cl. ..... 355/133; 271/307; 355/3 SH; 355/3 TR; 355/14 SH; 430/97; 430/100

[58] Field of Search ..... 355/3 R, 3 SH, 3 TR, 355/14 SH, 133; 271/307, 310, DIG. 1; 430/97, 100

[56] References Cited

U.S. PATENT DOCUMENTS

| | | | |
|---|---|---|---|
| 3,450,402 | 6/1969 | Weiler | 271/308 |
| 3,508,824 | 4/1970 | Leinbach et al. | 271/310 X |
| 3,870,515 | 3/1975 | Kaupp | 430/126 |
| 3,901,698 | 8/1975 | Fukushima et al. | 430/100 |
| 3,912,257 | 10/1975 | Gibbons | 271/310 |
| 3,945,823 | 3/1976 | Parent et al. | 430/100 |
| 3,970,381 | 7/1976 | Meagher et al. | 271/DIG. 2 X |
| 4,288,515 | 9/1981 | Yamashita et al. | 430/100 |

*Primary Examiner*—Fred L. Braun

*Attorney, Agent, or Firm*—Wenderoth, Lind & Ponack

[57] ABSTRACT

A copy paper separating method for use in an electrophotographic copying apparatus which forms a latent electrostatic image on a recording member is provided. The method includes the step of depositing fine particles having insulating properties and charged to a polarity opposite of that of the toner image on the surface of the recording member before the copy paper is placed over the recording member, to cause the particles to reduce the electrostatic attraction between the copy paper and the recording member, thereby facilitating separation of the copy paper from said recording member.

6 Claims, 4 Drawing Figures

COPY PAPER SEPARATING METHOD FOR USE IN ELECTROPHOTOGRAPHIC COPYING APPARATUS

BACKGROUND OF THE INVENTION

1. Technical Field

The present invention relates to a copy paper separating method for use in an electrophotographic copying apparatus which performs steps comprising forming a latent electrostatic image on a recording member, developing the latent image to a toner image, placing copy paper over the toner image on the recording member, charging the rear side of the copy paper to a polarity opposite to that of the toner by corona discharge to transfer the toner image from the recording member to the front side of the copy paper, and thereafter separating the copy paper from the recording member.

2. Prior art

Methods of separating the copy paper from the recording member heretofore known are divided into two general types: one in which a pawl, belt or like separating means (U.S. Pat. No. 3,450,402) is brought into contact with the recording member to forcibly separate the copy paper therefrom, and the other in which air is forced in between the leading end of the copy paper and the recording member, or the copy paper is subjected to suction on its rear side, or the charge on the rear side of the copy paper is erased by a.c. corona discharge, the methods of the latter type thus using separating means (U.S. Pat. No. 3,870,515) kept out of contact with the recording member for separating the copy paper.

Although the separating methods of the former type are advantageous over the latter in being much less prone to separation failures, the former methods have a drawback such that the separating pawl is likely to mar the surface of the recording member, or the use of the separating belt does not permit formation of a toner image on an end portion of the copy paper.

The latter methods are free of the above drawback. However, since the copy paper electrostatically attracted to the recording member is separated therefrom by a force applied to the paper to overcome the electrostatic attraction, separation difficulties or failures are liable to occur generally with variations in the ambient conditions (as when the ambient humidity is low) or variations in the properties of the copy paper (as when the copy paper is thin or has a high resistivity) which greatly alter the electrostatic attraction. Such failures may be reduced by subjecting the copy paper to an increased force of air or suction or to a.c. corona discharge at a higher voltage, but toner images of impaired quality will then result. Accordingly there is a limitation on the increase of the air or suction force, while the a.c. corona discharge method involves extreme difficulties in setting the discharge voltage.

SUMMARY OF THE INVENTION

Object

The object of the present invention which has been accomplished in view of the foregoing problems, provides a method of separating copy paper free of trouble, by use of non-contact type separating means which is set under usual conditions, even when the electrostatic attraction on the copy paper increases due to variations in the ambient conditions or in the properties of the copy paper.

To fulfull this object, we conducted various experiments using a.c. corona discharge unit as the separating means and found the following phenomena.

The discharge unit was set at the same voltage value as is usually used, under the ambient condition of normal humidity and was thereafter used at a lower humidity to check for the failure of separation of copy paper. As a result, the copy sheets failing to separate properly were found to be all alike in the state of toner image, i.e. in the state of deposition of the toner, as distinct from the separated copy sheets. More specifically stated, little or no toner deposition was found on the leading end portions of the former sheets, whereas larger amounts of toner deposition were found on the leading end portions of the separated sheets.

These phenomena indicate that the electrostatic attraction acting on the copy sheet bearing the toner on its leading end portion is smaller, permitting separation of the sheet without the necessity of increasing the voltage of the corona discharge unit even under the ambient condition of low humidity.

Summary

The present invention, accomplished with attention directed to the above phenomena, is characterized in that in an electrophotographic copying apparatus of the toner image transfer type, fine particles having insulating properties charged to a polarity opposite to that of the toner forming a toner image are deposited on the surface of a recording member before copy paper is placed over the recording member to cause the particles to reduce the electrostatic attraction between the copy paper and the recording member when the copy paper is to be separated from the recording member and thereby facilitate separation of the copy paper.

DESCRIPTION OF THE PREFERRED EMBODIMENTS

Figure 1:
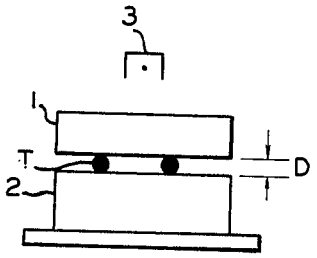
FIG. 1 is a schematic diagram illustrating the principle of this invention.

FIG. 1 illustrates the principle of the invention based on the electrostic attraction acting between copy paper 1 and a recording member 2 and produced when a toner image is transferred to the paper. The drawing shows a gap d between the copy paper 1 and the recording member 2 retaining toner particles T thereon. A transfer corona discharge unit 3 charges the rear side of the copy paper 1 to a polarity opposite to that of the toner T for the transfer of the toner.

The electrostatic attraction on the copy paper, which is dependent on the intensity of the electrical field in the gap d, increases with an increase in the intensity of the electrical field. The electrical field is dependent on the gap d and on the charge given to the rear side of the copy paper by the discharge unit 3. The larger the gap d, the weaker is the gap electrical field and the smaller is the electrostatic attraction on the copy paper 1.

When a toner image is actually transferred with toner particles T present in the gap portion, the gap d is larger and the electrostatic attraction on the copy paper 1 is smaller than in the absence of the toner T.

We conducted an experiment to measure the gap d and found that the gap d was about $1\mu$ in the absence of the toner T and 10 to $20\mu$ in the presence of the toner T and that the electrostatic attraction on the copy paper was about 10 times greater when the gap d was 1μ than when it was 15μ. This reveals that the toner T, when present on the recording member 2, reduces the electrostatic attraction on the copy paper 1, consequently facilitating separation of the paper 1 from the recording member 2.

Thus it is useful to deposit an increased amount of toner particles T on the recording member 2 to render the copy paper 1 separable more easily. This can be realized when copying an original having a large image area (black area) on its leading end portion since a large amount of toner particles T will then be deposited on the recording member 2, whereas when copying an original with a large nonimage area (blank area) on its leading end portion, the recording member 2 will bear a small amount of toner particles T thereon, exerting increased electrostatic attraction on the copy paper 1.

We have found that when fine particles of insulating properties charged to a polarity opposite to that of the toner on the image area of the recording member 2 are deposited on the nonimage area thereof before the transfer of the image, when copying an orginal with a large blank area, the electrostatic attraction on the copy paper can be reduced as when copying originals having a large black area, without permitting transfer of the fine particles to the copy paper. This finding has matured to the present invention.

Fine particles of insulating properties useful in this invention are 10 to 30μ in average size and at least $10^{13}$ ohm-cm in volume resistivity and which can be charged to a polarity opposite to that of the toner. With a resistivity of at least $10^{13}$ ohm-cm, the fine particles, when so charged, retain the charge and will not be transferred along with the toner. The fine particles should be up to 30μ in average size to avoid improper transfer of the toner, while they must be at least 10μ in average size so as to have substantially the same lower limit value as the toner.

As is the case with toners, useful materials for preparing such fine particles are insulating resins, such as polyethylene, polyacrylate, polymethyl methacrylate, polystyrene, styrene-acrylic resin, styrene resin, epoxy resin, cumarone resin, maleic acid resin, phenolic resin and fluorine-containing resin. Also useful are these insulating resins having dispersed therein finely divided magnetic materials, such as $Fe_2O_3$, $Fe_3O_4$ and ferrite.

Fine paarticles of insulating properties are deposited on the nonimage area of the recording member by charging the particles to a polarity opposite to that of the toner and subjecting the particles to a reversal developing process with application of a bias voltage having the same polarity as the surface potential on the recording member at the nonimage area of the latent electrostatic image thereon and, for example, about 50 to about 100 V higher than the surface potential.

Examples of the invention will be described below.

EMBODIMENT 1

Figure 2:
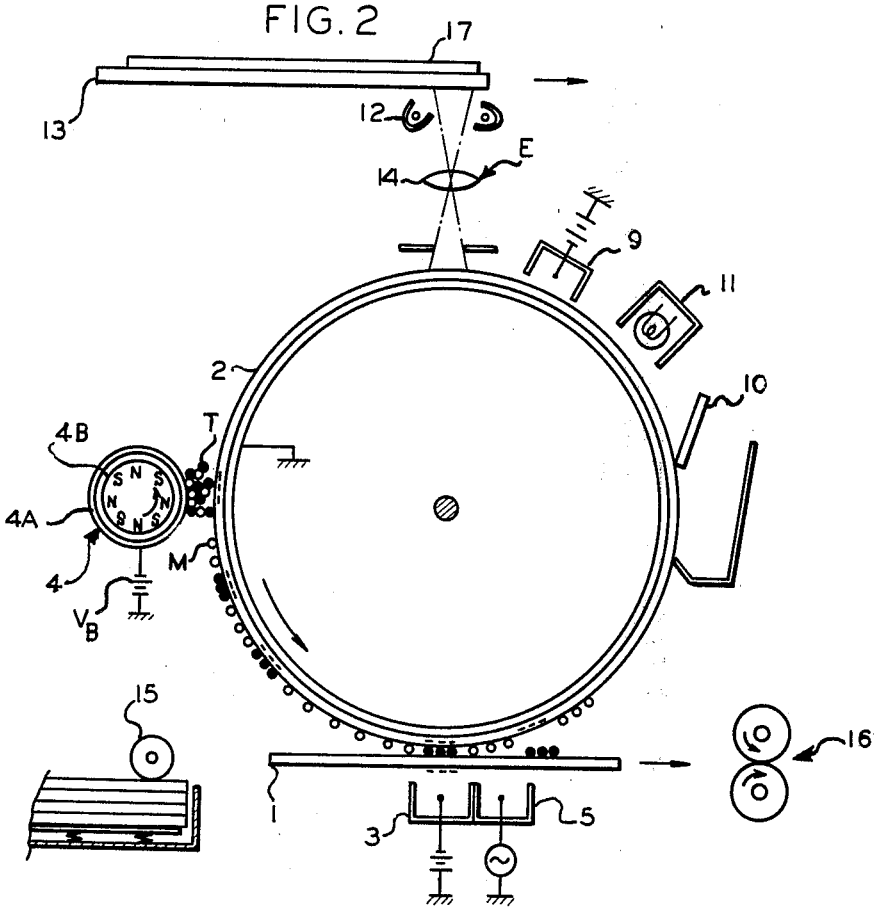
FIGS. 2 and 4 are schematic diagrams each showing a different embodiment of the invention.

FIG. 2 shows an embodiment in which insulating fine particles are deposited during development. The fine particles used are insulating magnetic particles M prepared from an insulating resin having dispersed therein a finely divided magnetic material.

With reference to the drawing, a recording member 2 is in the form of a photoconductive drum comprising an electroconductive plate and a photoconductive layer formed over the plate and rotatable in the direction of an arrow. Arranged around the photoconductive drum in the direction of rotation thereof are a sensitizing corona charger 9, an exposure unit E for the image of an original 17, a developing unit 4, a transfer corona charger 3, a separating corona charger 5, a cleaning unit 10 and an eraser lamp 11. The exposure unit E includes a light source 12, which illuminates the original 17 on a support 13. A projection lens 14 continuously projects the image of the original 17 on the photoconductive drum 2. The charger 9 uniformly charges the drum 2 in rotation, and when the charged area of the drum 2 has reached the exposure station, the original support 13 travels in the direction of an arrow in timed relation with the rotation of the drum to expose the drum to the image of the original, whereby a latent electrostatic image corresponding to the image is formed on the drum 2. The latent image is developed to a toner image by the developing unit 4. Before the toner image reaches the transfer station, a paper feeder 15 starts to feed copy paper 1 to the drum 2 in such timed relation that the copy paper 1 is placed over the toner image at the transfer station. After the toner image has been transferred from the drum to the surface of the copy paper 1 by the transfer charger 3 at the transfer station, the copy paper 1 is separated from the drum surface by the separating charger 5 and then fed to fixing rollers 16. The completed copy is discharged from the apparatus. On the other hand, the toner remaining on the drum after the image transfer is removed by the cleaning unit 10. The drum surface is further entirely illuminated by the eraser lamp 11 to remove the residual potential from the drum. With the copying cycle thus completed, the drum 2 is now ready for the next cycle.

While the known construction of an electrophotographic copying apparatus has been described above for illustrative purposes, a detailed description will be given of the present embodiment as adapted for this copying apparatus.

A two-component developer comprising the abovementioned insulating magnetic particles M and toner particles T is used for the developing unit 4 which is a magnetic brush developing unit comprising a stationary developing sleeve 4*a* and a rotatable magnet roll 4*b*. When the sensitizing charger 9 and the exposure unit E form latent electrostatic images of negative polarity on the photoconsuctive drum 2, the magnetic particles M are negatively charged by frictional contact with toner particles T and function as a carrier which positively charges the toner T and transports the toner T to the developing station. The developing bias voltages $V_B$ is of the same polarity as the surface potential on the nonimage area of the latent electrostatic image and is set at a higher value than the potential. When the latent image is developed by the unit 4, the application of the bias voltage $V_B$ deposits the toner T only on the image area of the latent image by the specified developing process, while depositing magnetic particles M only on the nonimage area by the reversal developing process. The toner T and magnetic particles M thus deposited on the drum 2 travel in the direction of an arrow. The copy paper 1 fed to the drum is placed over the deposition and uniformly negatively charged on its rear side by the corona charger 3 at the transfer station, where the positively charged toner T is transferred to the paper 1 but the negatively charged magnetic particles M are not transferred. The negative charges on the rear side of the copy paper 1 are thereafter neutralized in an electric field which is set up under the ambient condition of normal humidity by the separating a.c. corona charger 5. Consequently, even when a blank area predominates the original image, the magnetic particles M are present between the drum 2 and the copy paper 1 to be separated therefrom, reducing the electrostatic attraction on the copy paper 1 and assuring separation of the paper 1 even at a low humidity.

Given below is an experimental example according to the above embodiment.

EXPERIMENTAL EXAMPLE 1

Latent electrostatic images were formed on the photoconductive drum 2 with their image areas at a surface potential of −550 V and the nonimage areas at a surface potential of −250 V. The drum 2 was driven at a circumferential speed of 11 cm/sec.

The distance between the drum 2 and the developing sleeve 4*a* of the unit 4 was set at 0.7 mm, the magnetic intensity of the magnetic roller 4*b* thereof at 1000 gauss, and the developing bias voltage $V_B$ at −300 V.

Insulating magnetic particles M, 20μ in average size and $10^{14}$ ohm-cm in volume resistivity, were prepared from 100 parts by weight of styrene-acrylic resin ("HYMER SBM 73," product of Sanyo Chemical Industries, Ltd., Japan), 200 parts by weight of $Fe_3O_4$ ("Magnetite RB-BL," product of Chitan Kogyo Co., Ltd., Japan) and 4 parts by weight of carbon black ("MA #100," product of Mitsubishikasei Co., Ltd., Japan) by kneading the ingredients, followed by pulverization and classification. A toner T, 11μ in average particle size and at least $10^{15}$ ohm-cm in volume resistivity, was prepared from 100 parts by weight of styrene resin ("Piccolastic D-125," product of Esso Standard Co.), 8 parts by weight of carbon black (the same as above) and 2 parts by weight of a dye ("Oil Black BS," product of Orient Chemical Co., Ltd., Japan) by kneading, pulverization and classification. Magnetic particles M and the toner T were mixed together in a ratio of 9:1 by weight.

Both the transfer corona charger 3 and the separating a.c. corona charger 5 were given a voltage of 6 KV.

Under the foregoing conditions and ambient conditions of 20° C. and low humidity of 20% RH, copies of an original having a blank area at its leading end were made without any separation failure. The nonimage area on the drum 2 was found to have 0.01 mg/cm$^2$ of insulating magnetic particles M deposited thereon. The nonimage area on the copy paper 1 was free from any deposition of magnetic partcles M.

The same procedure as above was repeated under the ambient conditions of 20° C. and normal humidity of 60% RH, using copy paper 1 having a higher volume resistivity of $10^{12}$ ohm-cm. No separation failure occurred, with similar results achieved as to the deposition of magnetic particles M.

EMBODIMENT 2

Figure 3:
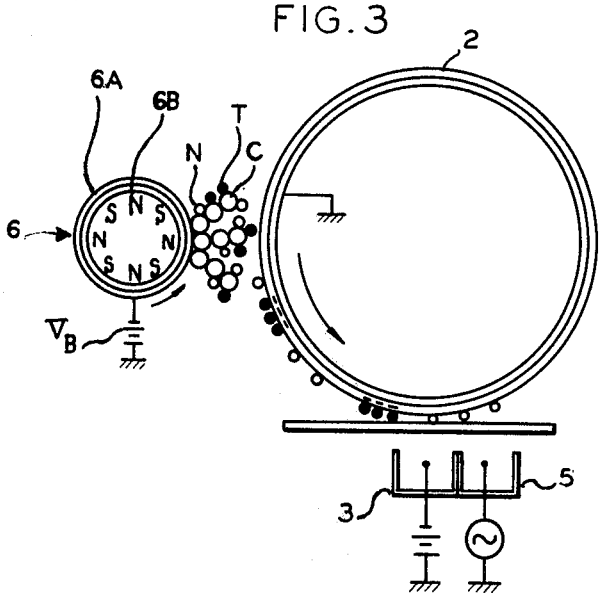

FIG. 3 shows another embodiment in which fine particles of insulating properties are deposited during development. The fine paarticles used are insulating nonmagnetic particles N prepared from an insulating resin only.

With reference to FIG. 3, a three-component developer composed of the above-mentioned insulating nonmagnetic particles N, toner particles T and iron carrier particles C is used for a developing unit 6 which is a magnetic brush developing unit comprising a rotary developing sleeve 6*a* and a stationary magnetic roller 6*b*. By frictional contact with iron carrier particles C, the nonmagnetic particles N are negatively charged to the same polarity as a latent electrostatic image on a photoconductive drum 2, and the toner particles T are positively charged to the opposite polarity. The developing bias voltage $V_B$ is of the same polarity as the surface potential on the nonimage area of the latent electrostatic image and is set at a higher value than the potential. When the latent image of negative polarity on the drum 2 is developed by the unit 6, the application of the bias voltage $V_B$ deposits the toner 1 only on the image area of the latent image by the specified developing process, while depositing nonmagnetic particles N only on the nonimage area by the reversal developing process. The present embodiment will not be described further since it is similar to Embodiment 1 with the exception of the above feature.

Given below is an experimental example according to the above embodiment.

EXPERIMENTAL EXAMPLE 2

Latent electrostatic images were formed on the photoconductive drum 2 with their image areas at a surface potential of −550 V and the nonimage areas at a surface potential of −200 V. The drum 2 was driven at a circumferential speed of 11 cm/sec.

The bias voltage $V_B$ for the developing unit 6 was set at −300 V.

Insulating nonmagnetic particles N, 11μ in average size and at least $10^{15}$ ohm-cm in volume resistivity, were prepared from 100 parts by weight of styrene-acrylic resin ("HYMER SBM 73," product of Sanyo Chemical Industries, Ltd., Japan), 8 parts by weight of carbon black ("MA #100," product of Mitsubishikasei Co., Ltd., Japan) and 2 parts by weight of a metallic dye ("CR-20," product of Orient Chemical Co., Ltd., Japan) by kneading, pulverization and classification. The same toner T as used in Experimental Example 1 was used. The nonmagnetic particulate material N and the toner T were mixed, each in a proportion of 5% by weight based on iron carrier particles C, with the carrier C.

The voltage applied to the transfer corona charger 3 of negative polarity, as well as to the separating a.c. corona charger 5, was 6 KV.

Under the foregoing conditions and ambient conditions of 20° C. and low humidity of 20% RH, copies of an original having a blank area at its leading end were made, with the result that no separation failure occurred. The nonimage area on the drum 2 was found to have 0.005 mg/cm$^2$ of insulating nonmagnetic particles N deposited thereon. The nonimage area on the copy paper 1 was free from any deposition of nonmagnetic particles N.

The same procedure as above was repeated under the ambient conditions of 20° C. and normal humidity of 60% RH, using copy paper 1 having a higher volume resistivity of $10^{12}$ ohm-cm. No separation failure occurred, with similar results achieved as to the deposition of nonmagnetic particles N.

EMBODIMENT 3

Figure 4:
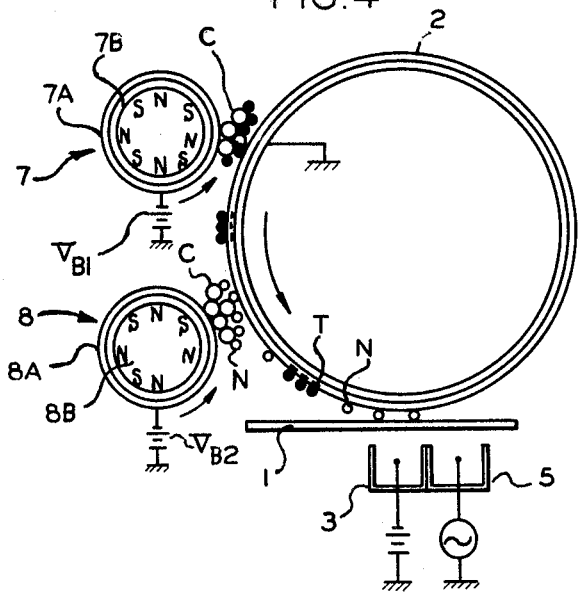

FIG. 4 shows another embodiment in which fine particles of insulating properties are deposited at a location between the developing station and the transfer station. The fine particles used are insulating non-magnetic particles N prepared from an insulating resin only.

With reference to FIG. 4, a two-component developer composed of toner particles T and iron carrier particles C is used for a developing unit 7 which is a magnetic brush developing unit comprising a rotary developing sleeve 7*a* and a stationary magnetic roller 7*b*. By frictional contact with carrier particles C, toner particles T are charged to positive polarity opposite to the polarity of latent electrostatic images on a photoconductive drum 2.

A two-component developer composed of the above-mentioned insulating nonmagnetic particles N and iron carrier particles C is used for a developing unit 8 which is a magnetic brush developing unit comprising a rotary developing sleeve 8*a* and a stationary magnet roll 8*b*. By frictional contact with iron carrier particles C, the nonmagnetic particles N are negatively charged to the same polarity as latent electrostatic images on the drum 2.

The developing bias voltages $V_{B1}$ and $V_{B2}$ for the developing units 7 and 8 are each of the same polarity as the surface potential on the nonimage area of the latent electrostatic image and set at a higher value than the potential. The latent electrostatic image of negative polarity on the drum 2 is developed by the unit 7 with the application of the bias voltage $V_{B1}$, such that the toner T is deposited only on the image area of the latent image by the specified developing process. Subsequently the developing unit 8 applies the bias voltage $V_{B2}$ to the image, depositing nonmagnetic particles N only on the nonimage area thereof by the reversal developing process. The present embodiment will not be described further since it is similar to Embodiment 1 with the exception of the above feature.

Given below is an experimental example according to the above embodiment.

EXPERIMENTAL EXAMPLE 3

The developing bias voltages $V_{B1}$ and $V_{B2}$ for the developing units 7 and 8 were set each at −300 V. A nonmagnetic particulate material N of insulating properties and a toner T, the same as those used in Experimental Example 2, were mixed, each in a proportion of 5% by weight based on iron carrier particles C, with the carrier C. The other conditions were the same as those employed in Experimental Example 2.

Under the conditions described and the ambient conditions of 20° C. and low humidity of 20% RH, copies of an original having a blank area at its leading end were produced, with the result that no separation failure occurred. When checked for the deposition of particles N, the drum 2, as well as the copy paper 1, was found to be in the same state as observed in Experimental Example 2.

The same results as above were also achieved when the above procedure was repeated under the ambient conditions of 20° C. and normal humidity of 60% RH, using copy paper 1 having a higher volume resistivity of $10^{12}$ ohm-cm.

For comparison, the following experiment was conducted by a conventional method, i.e., in the same manner as in Embodiment 3 except that the developing unit 8 was not used.

COMPARATIVE EXPERIMENTAL EXAMPLE

Copies of an original with a blank area at its leading end were made at 20° C. and a low humidity of 20% RH under exactly the same conditions as set for Experimental Example 3 except that the developing unit 8 was not used. Separation failures occurred. The non-image are on the drum 2 was found to be free from the toner T.

The same results as above were achieved when the above procedure was repeated under the ambient conditions of 20° C. and normal humidity of 60% RH, using copy paper 1 having a higher volume resistivity of $10^{12}$ ohm-cm.

However, no separation failure took place when copies of an original having a blank area at its leading end were made under the ambient conditions of 20° C. and normal humidity of 60% RH, using usual copy paper 1 having a volume resistivity of $10^{10}$ ohm-cm. While the nonimage area on the drum 2 was found to be free from the toner T, the good result is attributable to the function of the a.c. corona charger 5 which sufficiently reduced the electrostatic attraction on the copy paper 1.

The experimental examples given above reveal that even when the electrostatic attraction on the copy paper increases due to variations in the ambient conditions or in the properties of the copy paper, the paper can be properly separated from the recording member by depositing fine particles of insulating properties, charged to a polarity opposite to that of the toner image, on the surface of the recording member by the reversal developing process before the paper is placed over the recording member.

As exemplified in Experimental Example 1, the amount of fine insulating particles to be deposited can be as small as about 0.01 mg/cm$^2$. For the reversal developing process, therefore, the developing bias voltage is settable more easily at a lower level than is the case with other conventional processes for the forming of toner images.

Although an a.c. corona charger is used as conventional separating means in the foregoing experimental examples, the present invention is similarly useful for other separating means of the noncontact type.

ADVANTAGES

The copy paper separating method of this invention has the following advantages. With use of conventional separating means of the noncontact type, the copy paper can be separated free of any trouble even when the electrostatic attraction on the copy paper increases, for example, due to variations in the ambient conditions or in the properties of the copy paper. The present method, which reduces the electrostatic attraction between the copy paper and the recording member, serves to mitigate the load on the conventional separating means used. Especially when a.c. corona discharge is resorted to for separation, the discharge voltage is settable with ease. Since the method will in no way affect the image area, copy images are available free of any deterioration.

We claim:

1. A copy paper separating method for use in an electrophotographic copying apparatus which forms a latent electrostatic image on a recording member, develops the latent image to a toner image, places copy paper over the toner image on the recording member, charges the rear side of the copy paper to a polarity opposite to that of the toner by corona discharge to transfer the toner image from the recording member to the front side of the copy paper, and thereafter separates the copy paper from the recording member, which comprises a step of depositing fine particles having insulating properties charged to a polarity opposite to that of the toner image on the surface of the recording member by a reversal developing process before the copy paper is placed over the recording member to cause the particles to reduce the electrostatic attraction between the copy paper and the recording member when the copy paper is to be separated from the recording member, thereby facilitating separation of the copy paper.

2. A copy paper separating method as claimed in claim 1, wherein said step comprises depositing the insulating fine particles on a nonimage area on the recording member during development by the reversal developing process.

3. A copy paper separating method as claimed in claim 1, wherein said step comprises depositing the insulating fine particles on a nonimage area on the recording member after development by the reversal developing process.

4. A copy paper separating method as claimed in any one of claims 1 to 3, wherein said insulating fine particles are of 10 to 30$\mu$ in average size and at least $10^{13}$ ohm-cm in volume resistivity.

5. A copy paper separating method as claimed in claim 4, wherein said insulating fine particles consist of insulating magnetic particles prepared from an insulating resin having dispersed therein a finely divided magnetic material.

6. A copy paper separating method as claimed in claim 4, wherein said insulating fine particles consist of insulating nonmagnetic particles prepared from an insulating resin only.

* * * * *